US005808422A

United States Patent [19]

Venkitasubrahmanian et al.

[11] Patent Number: 5,808,422

[45] Date of Patent: Sep. 15, 1998

[54] LAMP BALLAST WITH LAMP RECTIFICATION DETECTION CIRCUITRY

[75] Inventors: Sreeraman Venkitasubrahmanian, Torrance; Clint Mason, Buena Park; Yongping Xia, Torrance; Feng-Kang Hu, Palos Verdes Estates, all of Calif.; Jaap Schlejen, Shanghai, China

[73] Assignee: Philips Electronics North America, New York, N.Y.

[21] Appl. No.: 645,545

[22] Filed: May 10, 1996

[51] Int. Cl.[6] ..... H05B 37/02

[52] U.S. Cl. ..... 315/225; 315/127; 315/224

[58] Field of Search ..... 315/224, 307, 315/DIG. 4, DIG. 5, 119, 121, 122, 123, 124, 125, 94, 107, 225, 127

[56] References Cited

U.S. PATENT DOCUMENTS

| | | | |
|---|---|---|---|
| 5,187,414 | 2/1993 | Fellows et al. | 315/307 |
| 5,475,284 | 12/1995 | Lester et al. | 315/209 R |
| 5,574,335 | 11/1996 | Sun | 315/119 |

FOREIGN PATENT DOCUMENTS

| | | |
|---|---|---|
| 0576991A2 | 1/1994 | European Pat. Off. . |
| 60-117162 | 6/1985 | Japan . |
| 1166495 | 6/1989 | Japan . |
| 1251591 | 10/1989 | Japan . |
| 613192 | 1/1994 | Japan . |
| 6140177 | 5/1994 | Japan . |

*Primary Examiner*—Robert J. Pascal
*Assistant Examiner*—David H. Vu
*Attorney, Agent, or Firm*—Brian J. Wieghaus

[57] ABSTRACT

A ballast for a gas discharge lamp includes a detection circuit which detects an operating state of the lamp in which the lamp current for the column discharge of one polarity is different from the lamp current for the column discharge of the other polarity by detecting the DC component of the voltage across the discharge lamp. The detection circuit includes (i) a device coupled such that a DC voltage is imposed there across when the lamp current is different for the column discharge according to one polarity verses the other polarity, and (ii) a sensing circuit for sensing the DC voltage across the device. The device may be a capacitive device, and in a particularly inexpensive implementation, is a DC blocking capacitor or a ballast capacitor. The sense circuit senses when the DC voltage across the device exceeds a threshold value, which may corresponds to fully-rectified state of the lamp or more favorably, to a lesser state of imbalance. In another embodiment, the variance in the DC voltage across the lamp is detected at the midpoint of a bridge inverter. A control circuit changes the output of the ballasting circuit when the DC voltage exceeds the threshold value to turn off the lamp or to recurrently cycle the lamp on and off to signal the user that the lamp needs to be changed.

38 Claims, 7 Drawing Sheets

LAMP BALLAST WITH LAMP RECTIFICATION DETECTION CIRCUITRY

BACKGROUND OF THE INVENTION

The invention relates to a ballast for a gas discharge lamp, the ballast including a current limiting AC voltage source for maintaining a column discharge in the discharge lamp alternately with one polarity and with the opposite polarity, and a detection circuit for detecting asymmetry between the column discharge for one polarity and the column discharge of the opposite polarity.

Such a ballast is known from JP 1-251591.

During lamp operation, ballasts for gas discharge lamps commonly provide an AC voltage across the lamp so that the lamp current is alternating and a column discharge is maintained between the lamp electrodes during both the positive and negative half-cycles of the AC output voltage. During the positive half-cycle one electrode is the cathode and the other is the anode. The electrodes assume the opposite function for the negative half-cycle. When an electrode is the cathode it emits electrons to ignite and maintain the column discharge during the respective half-cycle. The electrodes typically include an electron emissive material which provides an ample supply of electrons when the electrode is the cathode. During lamp life, the discharge electrodes age and lose emitter material through known processes, typically at a slightly different rate. Consequently, it is common for the lamp to reach an end-of-life condition in which one of the electrodes, when the cathode, is unable to supply sufficient electrons to ignite and maintain the column discharge, which results in a column discharge being maintained during only the negative or positive half cycles of the AC output voltage. In this half-wave discharge condition, the lamp essentially acts as a rectifier.

The above-mentioned JP 1-251591 discloses that the non-discharging voltage of the lamp is higher than the discharging voltage, resulting in the amplitude of the AC voltage across both ends of the lamp being higher than during normal operation. JP 1-251591 includes a detection circuit which measures the AC voltage across the lamp, and detects the occurrence of the higher AC voltage when the lamp is in the half-wave condition.

SUMMARY OF THE INVENTION

It is an object of the invention to provide a ballast with an improved detection circuit for detecting asymmetry in the column discharge of a gas discharge lamp.

According to the invention, a ballast of the type described in the opening paragraph is characterized in that:

the detection circuit detects a DC voltage generated by the discharge lamp with asymmetry occurring between the column discharges of the one polarity and of the opposite polarity.

The invention is based on the recognition that with asymmetry between the column discharges the discharge lamp generates a DC voltage which has a larger change between the normal operating condition and any asymmetric condition of the lamp than the AC component. The invention is also based on the recognition that it is possible in certain lamps, particularly narrow diameter lamps, for the lamp envelope to fail long before the lamp reaches the full half-wave rectifying condition. As the emissive material is depleted from one of the electrodes, the cathode fall voltage of the lamp increases which raises the temperature of the electrode region and the glass of the lamp envelope in the seal adjacent the electrode. In this partially rectifying condition, the increase in temperature can cause rupture of the lamp vessel before the full half-wave condition is reached, and even before any visible flicker occurs.

The present inventors have found that the change in the AC voltage across the lamp is too small to reliably detect this partially rectifying condition. Detection is complicated by the fact that the difference in AC lamp voltage between lamps of the same type from different manufactures, as well as the variation with ambient temperatures, is often larger than the change in AC lamp voltage for a particular lamp between the normal and full half-wave condition. The change in the DC voltage across the lamp, however, is sufficiently large that a partially rectifying condition of the lamp can be reliably detected. As will be discussed with respect to a subsequent embodiment, the change in the DC component is sufficiently great as the lamp moves away from the normal operating condition so that the DC component provides a reliable indicator of the partially rectifying condition even for dimming ballasts.

In a favorable embodiment, the detection circuit includes (i) a device coupled such that a DC voltage is reflected there across when the lamp current is different for the column discharge according to one polarity verses the other polarity, and (ii) a sensing circuit for sensing the DC voltage across the device. The device may be a capacitive device, and in a particularly inexpensive implementation, is a DC blocking capacitor in the ballast which is otherwise normally present to block low level DC components from the lamp during operation. Alternatively, if the ballast includes a current limiting ballast capacitor, the DC lamp voltage reflected across this ballast capacitor may be detected. In still another embodiment, the DC voltage generated by asymmetric operation of the lamp is detected in a bridge circuit at an end of a load branch including the discharge lamp.

In another embodiment, the sensing circuit senses when the DC voltage across the device exceeds a threshold value. The threshold value may correspond to an end-of-life state of the lamp in which a column discharge occurs in the discharge lamp for only one polarity, i.e., the half-wave discharge condition. Alternatively, the threshold value may correspond to a lesser state of asymmetry in which the lamp current for the column discharge of one polarity is different from the lamp current for the column discharge of the other polarity. This threshold value is favorably set at a level which turns off the lamp prior to any overheating of the electrode region capable of causing lamp envelope failure. In one embodiment, the sense circuit includes a breakdown device, such as a zener diode, which breaks down and becomes conductive at the desired threshold voltage.

In yet another embodiment, a control circuit connected to the detection circuit changes the output of the current-limited AC voltage source when the DC voltage exceeds the threshold voltage. The control circuit may control the current-limited AC voltage source to turn off the lamp altogether. However, in one implementation according to the invention, the control circuit controls the current-limited AC voltage source to recurrently extinguish and ignite the discharge lamp with a predetermined dwell time in between, for example of several seconds. This "hiccup" operation serves as an indicator to the user that the lamp needs to be replaced.

In still another embodiment, the detection circuit allows for an imbalance in the lamp current which often occurs during ignition that would cause a DC voltage above the threshold value, so as to allow the lamp to ignite normally.

The detection circuit measures the amount of time the DC voltage is above the threshold value and does not alter the discharge lamp operation until the measured time exceeds a threshold time value. The threshold time value is selected to be above the expected time that the DC voltage generated by asymmetry in a "good" lamp during ignition will be above the threshold DC voltage value. In a favorable embodiment, the detection circuit measures the time that the DC voltage exceeds the threshold value through integration. When the DC voltage exceeds the first threshold value, the circuit measures elapsed time until the DC voltage falls below the threshold voltage, stores the elapsed time, and then increments the time value when the DC voltage subsequently exceeds the threshold value.

In yet another embodiment, the ballast is responsive to a dimming signal to adjust the AC voltage at the ballast output terminals for controlling the light level emitted by the discharge lamp between a maximum light level and light levels lower than said maximum light level corresponding to the dimming signal. The first threshold value is set such that the DC voltage exceeds the first threshold value for asymmetry between the column discharges of each polarity at a light level lower than the maximum light level.

These and other objects, features and advantages of the invention will become apparent with reference to the accompanying drawings and the following detailed description and claims.

BRIEF DESCRIPTION OF THE DRAWINGS

FIG. 5(*b*) illustrates a second embodiment of a half-wave discharge detection circuit according to the invention.

DETAILED DESCRIPTION OF THE PREFERRED EMBODIMENTS

Figure 1:
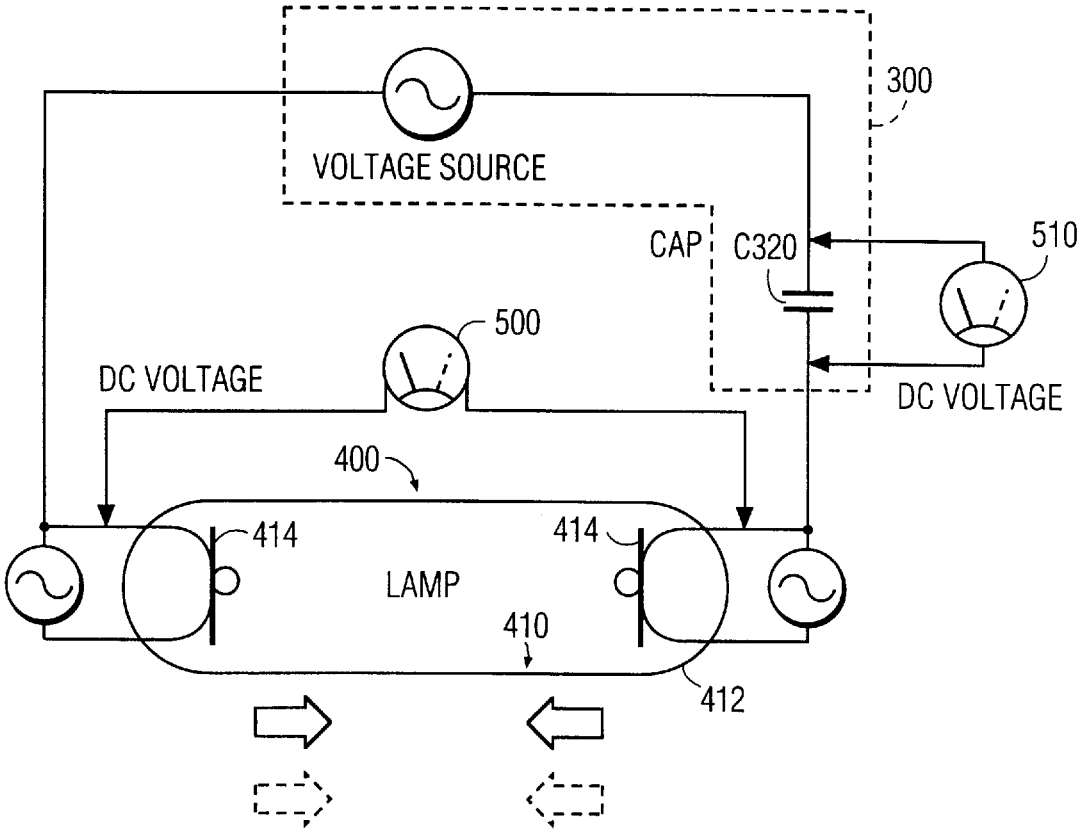
FIG. 1 schematically illustrates in simplified form a lamp system including a ballast and fluorescent lamp.

FIG. 1 illustrates schematically in the simplest form a lamp system including a low pressure mercury vapor gas discharge lamp 400, commonly known as a fluorescent lamp, and a ballast 300 for igniting and operating the lamp. The ballast 300 includes a current limited AC voltage source, which may be low or high frequency, and which includes capacitor 320 coupled in series with the lamp 400. The lamp includes a pair of tungsten filament electrodes 414 each provided with an electron emissive material having a lower work function than the tungsten, and a discharge sustaining fill of mercury and a rare gas. During operation, a column discharge is maintained between the electrodes 414 during both the positive and negative half-cycles of the AC voltage source. When an electrode 414 is the cathode it emits electrons to ignite and maintain the column discharge during the respective half-cycle.

Over lamp life, the electron emissive material is depleted from the electrodes, typically at a different rate for each electrode. This depletion is manifested by darkening of the lamp envelope in the area of the electrodes. As the emissive material nears full depletion, the tungsten material emits more electrons to support the discharge. Since the tungsten material has a higher work function, the cathode fall voltage increases. This causes an increase in temperature of the electrode region, with a consequent increase in temperature in the seal area 412. In effect, the increased cathode fall voltage causes the lamp to consume more power, with the additional power being dissipated in the form of heat at one end of the lamp. If lamp operation were to continue in this manner, there is the possibility that the lamp envelope could fail, even violently.

The imbalance between the electrodes effects the shape of the lamp current waveform. However, the magnitude of the lamp current for the half cycle in which the depleted electrode is the cathode will be substantially the same as for the other half-cycle in which the lesser depleted electrode is the cathode. For example, for a 26 W lamp the difference in the magnitude of the AC lamp current between normal lamp operation and a partially-rectifying condition sufficient to cause lamp damage is only on the order of 10–20 mA, as compared to nominal lamp current of 300 mA. This variance in the AC lamp current and the resulting AC voltage is difficult to detect in practice in a ballast for general use, since the nominal AC lamp voltage level differs to an even greater extent with temperature variations and with corresponding lamps from different manufacturers.

Figure 2:
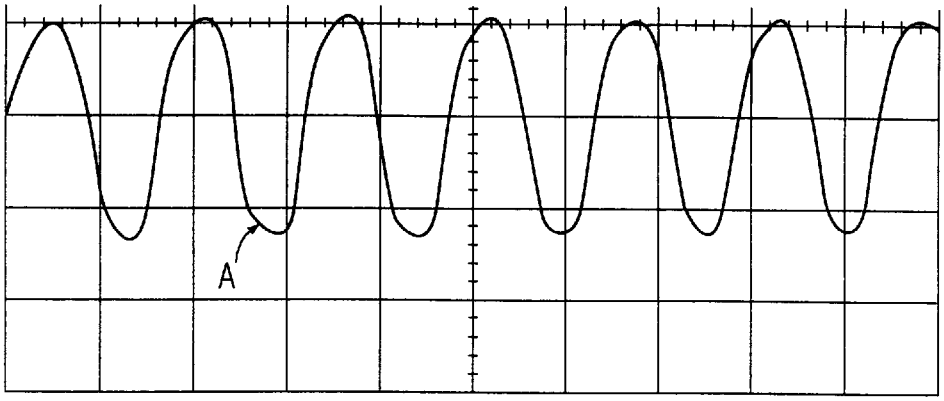
FIG. 2 shows the difference in the lamp current waveform between the positive and negative half-cycles for a partially rectifying condition of the lamp which could cause a lamp envelope failure.

Failure-causing overheating of the lamp envelope often occurs well before the fully rectified condition is reached, when the difference in the lamp current waveform between the positive and negative half-cycles is much smaller than for the fully rectified condition. FIG. 2 shows the typical lamp current waveform for a partially rectifying condition which was found to cause lamp envelope failure. The magnitude of the positive and negative half-cycles is essentially the same. The only difference is that the shape of the negative half-cycle near the crest (see ref. arrow A) is different than for the positive half-cycle. This minor difference in the waveform makes it impractical to use either the AC lamp current or the resulting AC voltage to detect this partially rectifying condition.

However, the difference in the lamp current causes a DC voltage across the lamp with a magnitude, both in absolute terms and as a percentage of the nominal lamp voltage, which is much easier to detect. In FIG. 1, the arrows diagrammatically represent the lamp current and the meters 500, 510 illustrate the DC lamp voltage. When the lamp current for both half cycles is at least substantially equal as represented by the arrows with solid lines, for example in a relatively new lamp, there is no or almost no DC voltage across the lamp. However, with an aged lamp in a partially rectifying condition (as represented by the dashed arrows), the product of the lamp impedance and the small differences in the lamp current waveform produces a DC voltage across the lamp (as indicated by the dashed needle on meter 500) which is easily detectable. For example, in a 26 W lamp, this DC voltage varies between 0 V for a new lamp and about 30 V for a lamp near end of life, as compared to a nominal lamp voltage of about 80 V.

This DC voltage can be measured in numerous ways. A very convenient circuit utilizes the reflection of the lamp voltage on other circuit components. As illustrated in FIG. 1, a DC voltage equal to the DC voltage across the lamp is reflected across the capacitor 320 connected in series with the lamp, as indicated by the meter 510. Depending on the ballast design, this capacitor could be a current limiting ballast capacitor or a DC blocking capacitor.

Figure 3:
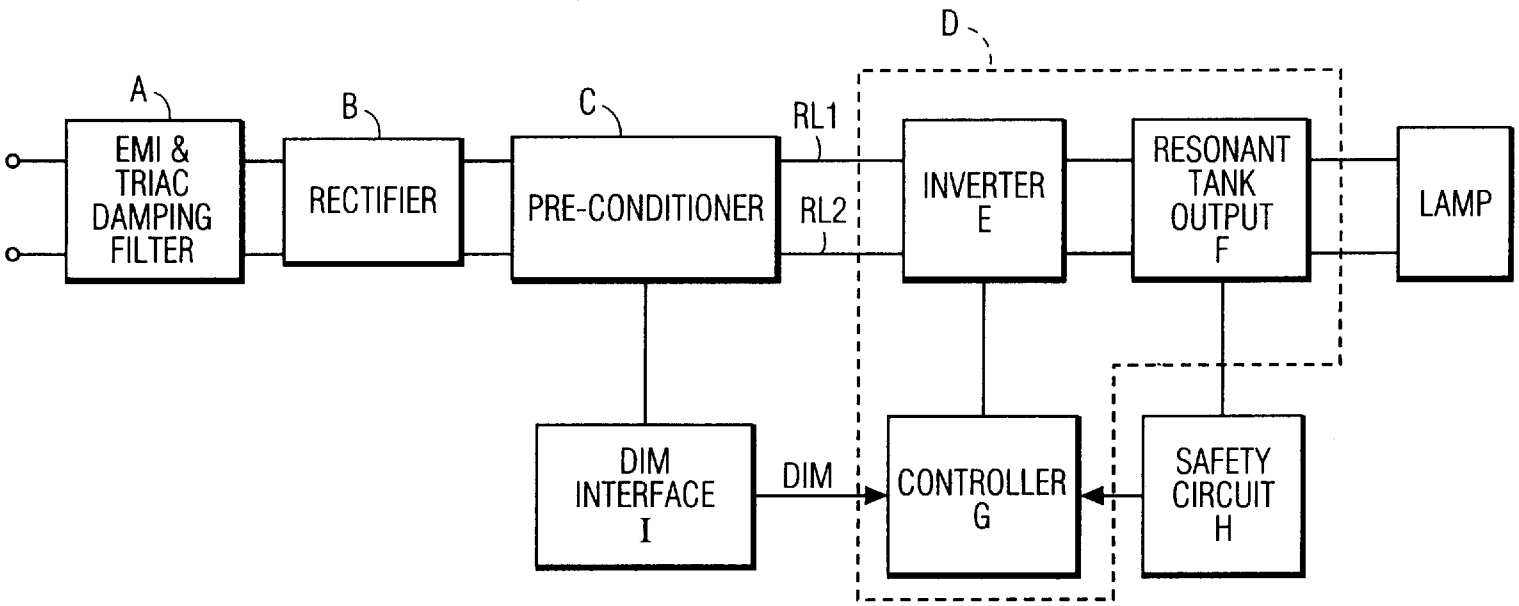
FIG. 3 is a block diagram of one type of electronic ballast with which detection current according to the invention may be incorporated.

FIG. 3 is a block diagram of one type of electronic ballast with which the detection circuit according to the invention may be incorporated. The lamp ballast shown in FIG. 3 includes an EMI and triac damping filter "A" connected to full bridge input rectifier "B", which together convert an AC power line voltage into a rectified, filtered DC voltage at an output thereof. The pre-conditioner circuit "C" includes circuitry for active power factor correction, as well as for increasing and controlling the DC voltage from the rectifier circuit B, which DC voltage is provided across a pair of DC rails RL1, RL2. Circuit "D" is a ballast circuit for controlling operation of the lamp and includes a DC-AC converter, or inverter, "E", resonant tank output circuit "F" and controller "G" which controls the inverter. The inverter E is a half-bridge configuration which under control of the half-bridge controller, or driver, circuit G provides a high frequency substantially square wave output voltage to the output circuit F. The resonant tank output circuit F converts the substantially square wave output of the half-bridge into a sinusoidal lamp current.

The safety circuit "H" provides a back-up stop function which prevents an output voltage from being present at the lamp terminals when one or both of the fluorescent lamps has failed or has been removed from its socket. The safety circuit also restarts the controller G when its senses that both filament electrodes in each lamp are good.

A dimming interface circuit "I" is connected between an output of the rectifier circuit B and a control input of ballast circuit present at the controller G to control dimming of the lamp. The dimming interface circuitry provides a dimming voltage signal to the controller G which is proportional to the setting of the phase angle dimmer. Such a ballast is known from and fully described in U.S. application Ser. No. 08/414,859 filed Mar. 31, 1995 entitled "Electronic Ballast With Interface Circuitry for Phase Angle Dimming Control", now U.S. Pat. No. 5,557,395, herein incorporated by reference.

Figure 4:
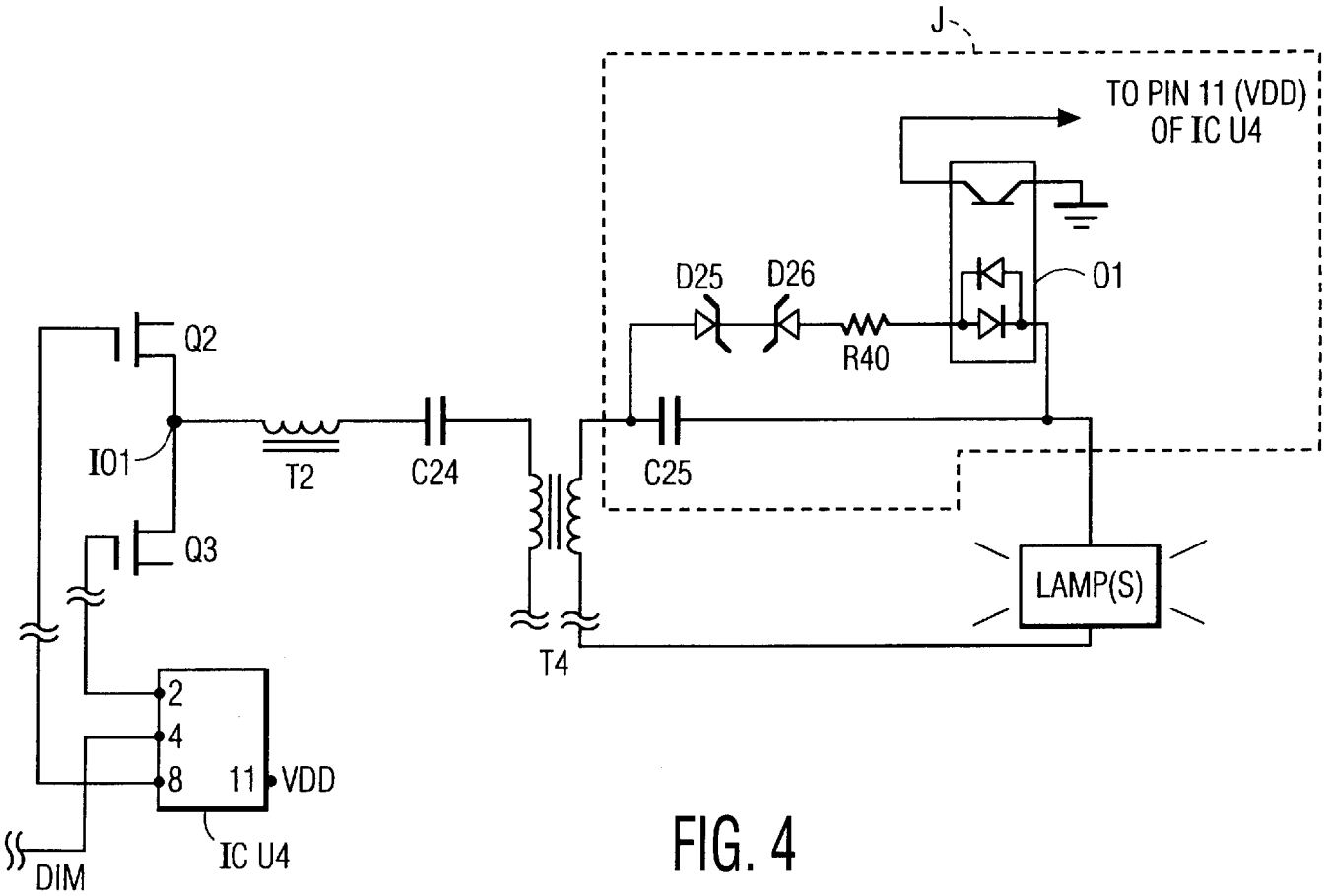
FIG. 4 illustrates a first embodiment of the half-wave discharge detection circuitry according to the invention.

FIG. 4 shows a first embodiment of the detection circuit for detecting a rectifying condition of the lamp(s) controlled by the ballast of FIG. 3. The DC blocking capacitor C25, the transformer T4, the power supply transformer T2, the inverter switches Q2 and Q3, and the integrated circuit IC U4 are the same as those shown in FIG. 2 of U.S. application Ser. No. 08/414,859. The detection circuit includes a sensing circuit J which activates a control circuit formed by the optocoupler O1. The sensing circuit includes a breakdown device in the form of a pair of zener diodes D25, D26 and a resistor R40 in series with the input terminals of the optocoupler, all connected in series across the DC blocking capacitor C25. Any DC components generated by the lamp in either direction are blocked by and are reflected across the DC blocking capacitor C25. The DC blocking capacitor C25 is otherwise present to block low level DC components generated in a "good" lamp which would adversely affect the operation of the output transformer 74. In FIG. 4, the zener diodes D25, D26 are each rated at 25 V. The resistor R40 functions to limit the current into the input terminals of the optocoupler, to a current suitable for the optocoupler, once the zener diodes breakdown in response to their combined breakdown voltage appearing across the DC blocking capacitor C25.

During normal operation, the lamp current during the positive half-cycle is substantially the same as during the negative half-cycle of the AC output voltage. Thus, an essentially balanced condition exists for the lamp current. As a result, the DC component of the voltage across each lamp is very small and, when reflected across the DC blocking capacitor C25, is insufficient to cause the zener diodes D25, D26 to breakdown. However, as the lamp current becomes asymmetric in one of the lamps, as shown in FIG. 2, the DC component of the lamp voltage will no longer be small, and when reflected across the DC blocking capacitor 24, will cause the zener diodes D25, D26 to breakdown. This causes the light emitting diode in the optocoupler to emit light, and close the switch within optocoupler O1, which has one switch terminal connected to ground and the other switch terminal connected to the power supply pin of the integrated circuit IC U4, which controls the switching of the half-bridge inverter switches Q2, Q3. This pulls down the supply voltage at pin VDD of the IC U4. With IC U4 turned off, the inverter stops oscillating and the lamps are extinguished. By turning off the lamps, damage to ballast components from the lamps operating in an unbalanced condition is avoided. More importantly, catastrophic failure of the lamp envelope due to overheating of the depleted cathode and the surrounding glass is prevented.

The IC U4 includes a dim input (Pin 4, DIM) for receiving a dim signal. The IC U4 controls the switching of switches Q2, Q3 to control the light level of the discharge lamp at a level corresponding to the dim signal. In the embodiment herein incorporated by reference from the above-mentioned U.S. application Ser. No. 08/414,859, the dim signal is a voltage supplied by a dim interface circuit receiving the rectified output of a triac dimmer. The dim signal can be supplied in other ways, however, such as directly by a third wire. As compared to full light output (lamp current=300 mA, AC lamp volts=80 V) discussed above, at low light levels, for example 5%, the lamp current is on the order of 10 mA and the AC lamp voltage is on the order of 160 V. Since the AC lamp voltage is much higher for the dimmed condition, detection of the AC voltage for determining a rectifying condition of the lamp is not practical since detection would be triggered merely by the dimming condition. In contrast, at the 5% light level, the DC voltage varies between 0 V for a good lamp to about 50 V for a rectifying condition which could lead to lamp failure, (as compared to 30 V for the 100% light level). Consequently, this DC voltage is even more readily detected for the dimming condition.

Figure 5A:
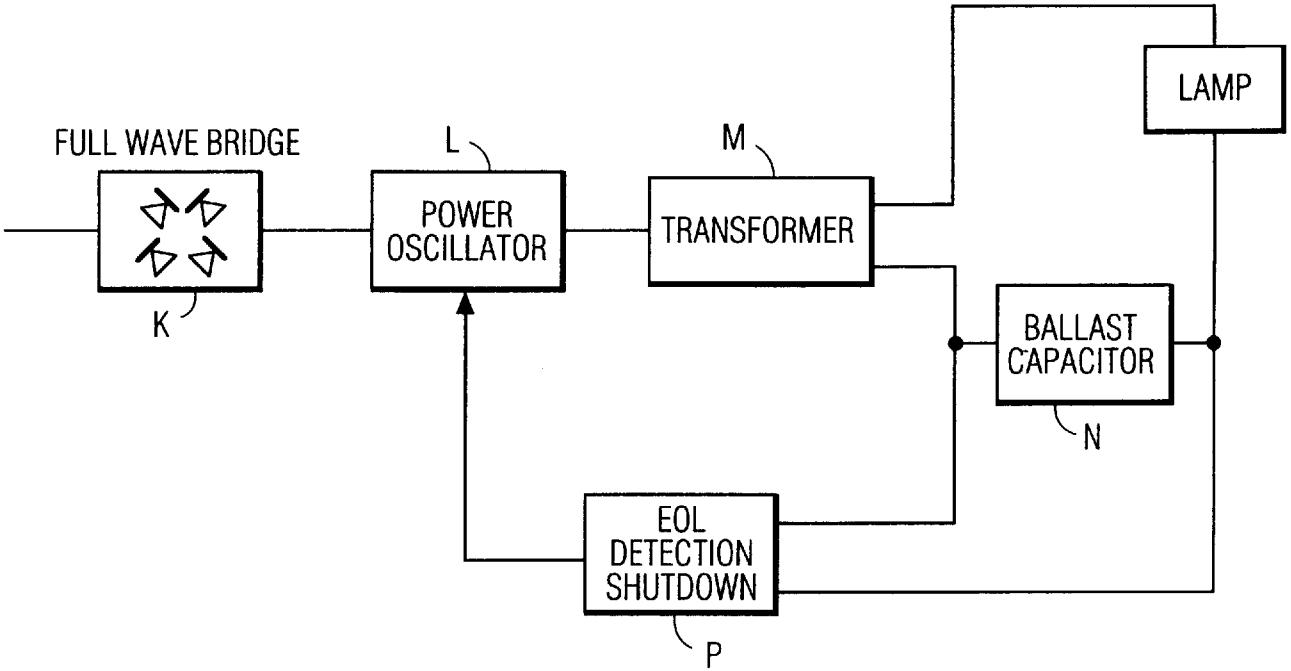
FIG. 5(*a*) is a block diagram of a ballast in which the DC voltage generated by the asymmetric condition of the lamp is detected across a ballast capacitor.
Figure 5B:
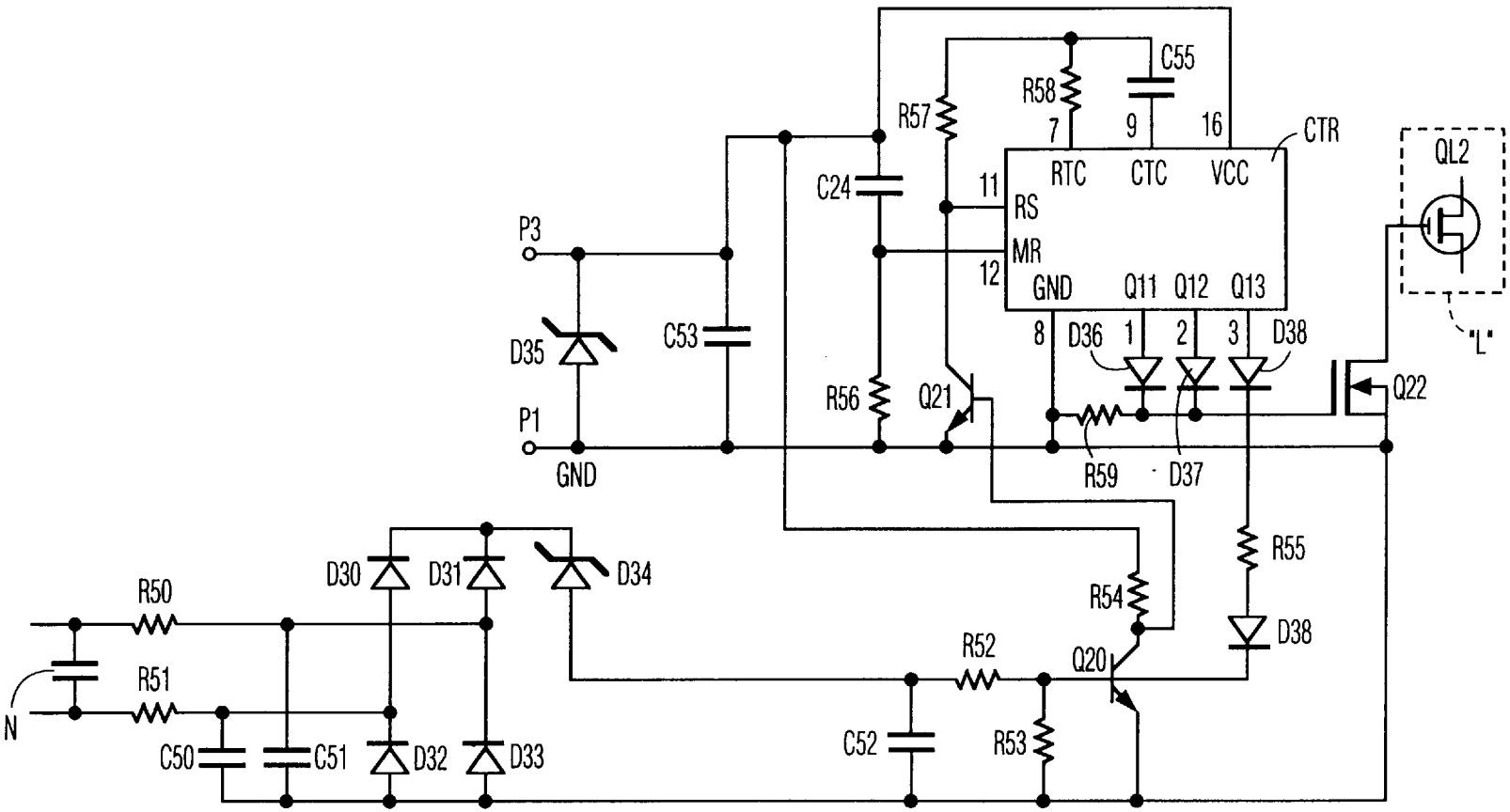

During lamp ignition it is possible that there will be asymmetry for a brief period of time even in a "good" lamp, for which it is not desired to shut down the inverter. This may be caused, for example, by the manner in which the electrodes are pre-heated. FIG. 5(*b*) discloses yet another embodiment of a detection circuit which prevents the ballast from being shutdown in this event. In particular, the circuit measures the time duration that the DC voltage is above the selected threshold level. If the time duration exceeds a first predetermined time, set longer than the typical ignition time for a "good" lamp, the ballast is shut off. The ballast remains off for a second time period, after which ignition is attempted. For a "good" lamp, the lamp will start and operate normally. For a rectifying lamp, the lamp will ignite and stay lit for the first time period and then be off for the second time period. The lamp will continue to cycle or "hiccup" in this manner, signalling to the user that the lamp needs to be replaced.

FIG. 5(*a*) is a block diagram of a ballast in which the DC voltage generated by the asymmetric condition of the lamp is detected across a ballast capacitor. The ballast of FIG. 5(*a*) has a full wave bridge rectifier "K" providing a DC voltage to a power oscillator "L", from an AC mains voltage input at the bridge rectifier. The power oscillator includes a pair of switches and provides a high frequency AC output voltage to a transformer "M". The discharge lamp is connected in series with a ballast capacitor "N" to a secondary winding of the transformer "M". The ballast transformer provides a constant voltage source while the capacitor N limits current to the lamp. The end-of-life ("EOL") detection circuit "P" is shown fully in FIG. 5(*b*).

The heart of the detection circuit is a 14 stage ripple binary counter CTR which measures the time that the DC voltage is above the threshold voltage, controls the hiccup operation of the lamp once the threshold is passed, and prevents a good lamp from being shut-off during ignition.

The counter CTR is powered by a low voltage supply provided at inputs P1 (ground) and P3, which may be for example a tapped winding of the transformer "M". The zener diode D35 is connected across the inputs 1, 3 in parallel with the capacitor C53, which together provide voltage regulation and filtering. The power input VCC of the counter CTR is connected to the DC bus from supply input P3. The resistor R58 and the capacitor C55 have an RC time constant which controls the oscillation frequency of an internal oscillator within counter CTR and are connected at respective inputs RTC and CTC. The resistor R58 and capacitor C55 are coupled to ground via pull-down resistor R57 through switch Q21. The internal oscillator only oscillates when switch Q21 is not conducting, i.e. in its OFF state. When switch Q21 becomes conductive (turns "ON"), the oscillator stops oscillating by grounding the RS input. Additionally, whenever power is applied to inputs P1, P3 to turn the counter CTR "ON", the multiple stages of counter CTR are reset to logic 0 by a pulse generated on the node between the resistor R56 and the capacitor C54 and the master reset input MR.

The DC voltage is sensed by a pair of sense resistors R50, R51 each connected to a respective end of the ballast capacitor "N". Since the ballast capacitor controls the current through the lamp, the sense resistors are selected to permit detection of the voltage across the ballast capacitor while drawing little current. The other ends of the resistors R50, R51 are connected to a full bridge rectifier consisting of diodes D30, D31, D32 and D33. The capacitors C50 and C51 filter the high frequency ripple present on the DC voltage sensed by the resistors R50, R51. The cathode of the zener diode D34 is connected to the output of the full bridge rectifier at the cathodes of D30 and D31. The zener diode D34 has a breakdown voltage selected as a predetermined threshold value for the DC voltage level, and also prevents noise from influencing the operation of the detection circuit. When the diode D34 breaks down, the switch Q20 transfers the breakdown voltage to a logic level. The base of switch Q20 is connected to the anode of the zener diode D34 via series resistor R52 which limits the current to the base. The emitter of switch Q20 is connected to the anodes of the diodes D32, D33 and to reference ground. The capacitor C52 provides additional filtering. The resistor R53 is a pull down resistor and ensures that the switch Q20 turns off when the detected voltage falls below the threshold voltage. The collector of switch Q20 is connected to the highside of the voltage regulator D35, C53 via the resistor R54 and to the base of switch Q21. The switch Q21 serves to invert the logic output of the switch Q20.

The counter CTR includes a 14 stage binary counter which counts the oscillations of the internal oscillator, whenever the input RS is high. The coupling of the outputs of these stages determines the length of the first and second time periods. In this embodiment, the $\overline{Q}$ outputs Q11, Q12, Q13 of the stages 11–13 are logic "OR"ed together via diodes D36, D37, D38. The cathodes of the diodes D36–D37 are connected to ground via the resistor R59, to the control gate of a mosfet switch Q22 and to the base of switch Q20 via a resistor R55 and a diode D38 connected in series. The source of the mosfet switch Q22 is connected to the base of switch $Q_{L2}$ of the power oscillator "L" and the drain of switch Q22 is connected to ground. Whenever the output of either of stages Q11, Q12, or Q13 are high, the output of the counter CTR is high.

The operation of the detection circuit is as follows. When power is applied to inputs P1, P3 the multiple stages of counter CTR are reset to logic 0. Switch Q20 is normally open and switch Q21 is normally closed, so the internal oscillator of the counter CTR is off. Whenever a DC voltage greater than the threshold voltage is present across the ballast capacitor "N", the zener diode D34 breaks down, closing switch Q20, which opens switch Q21. This causes the internal oscillator to oscillate and the 14 counter stages to count the internal oscillations. If the detected DC voltage across capacitor "N" falls below the threshold voltage. The switch Q20 opens, closing switch Q21 and stopping the internal oscillator of counter CTR. Counter CTR effectively stores the existing count. When the zener diode D34 subsequently breaks down again, switch Q20 closes, opening switch Q21, and restarting the internal oscillator and count of the counter CTR. Thus, the counter effectively integrates the time at which the DC voltage across ballast capacitor "N" exceeds the threshold voltage.

When the logic output Q11 of the 11th stage goes high, the ORed counter output is high. This closes the mosfet switch Q22, which grounds the base of the switch $Q_{L1}$ of oscillator "L", stopping oscillation of oscillator "L" and extinguishing the lamp. The high ORed output applied to the base of switch Q20 through resistor R55 and diode D38 keeps switch Q20 closed and switch $Q_{L2}$ open, thereby keeping the counter CTR counting. Counter CTR keeps counting until the ORed output of stages Q11–Q13 turns low, which signifies the end of the second time period being reached. When the ORed output turns low, both the mosfet switch Q22 and the bipolar switch Q20 open. The latter closes switch $Q_{L2}$, resetting counter CTR to count 0. Once switch Q22 opens, the base of switch $Q_{L1}$, is no longer grounded and the inverter ignites and operates the lamp. In one embodiment, the first time period was selected as 1.25 seconds and the second time period as 8.75 seconds. Thus, once a lamp reaches a stage where it rectifies the lamp current so that the resulting DC level is above the threshold value, the lamp will be lit for 1.25 seconds and off for 8.75 seconds. This cycle repeats and signals the user that the lamp needs to be changed.

It should be noted that the first time period is selected to be longer than any asymmetry in the lamp current which is expected to be present during ignition of a good lamp and which exceeds the threshold value. If such asymmetry occurs during ignition, the counter CTR will begin counting, but the DC voltage across the ballast capacitor will subsequently fall below the threshold value, thereby stopping counter CTR prior to the ORed counter output having turned high. Consequently, counter CTR will stop counting and the count will remain the same during lamp operation and not turn the lamp off since for a good lamp, the DC voltage will remain below the threshold value.

Figure 6:
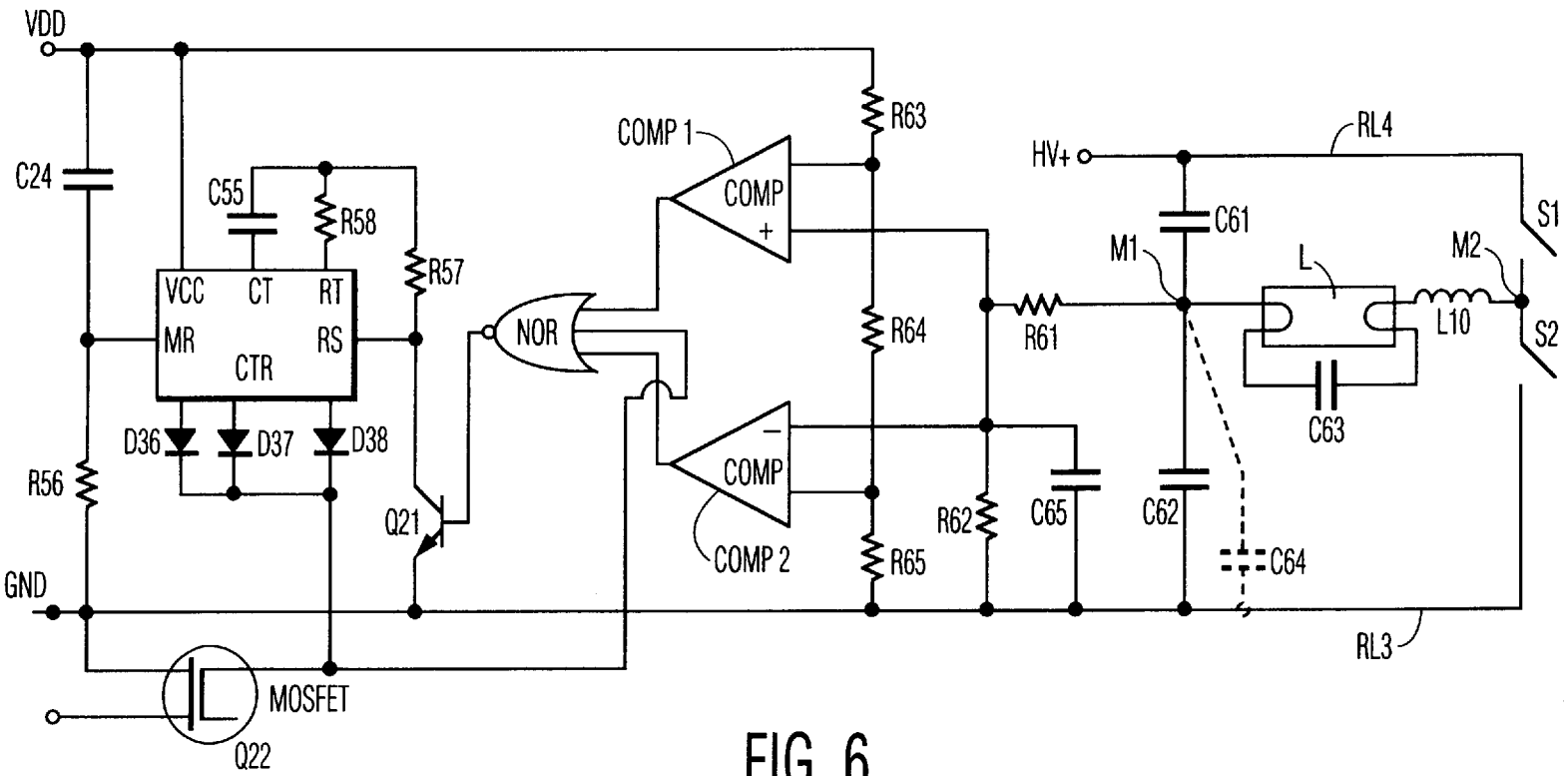
FIG. 6 illustrates a variation of the detection circuit of FIG. 5(*b*) used to detect the DC voltage reflected at the midpoint of a bridge inverter.

FIG. 6 shows yet another implementation for detecting the DC lamp voltage cause by a rectifying state of the lamp. The circuit takes advantage of the reflection of the DC lamp voltage to the midpoint of a bridge inverter in a non-isolated high frequency(HF) ballast, i.e. a HF ballast without an output isolation transformer as in the above-mentioned U.S. application Ser. No. 08/414,859. Such a ballast may be used, for example, in a compact fluorescent lamp. In FIG. 6, only the relevant portion of the bridge inverter is shown, which in this implementation is half-bridge having a first DC bus RL3 at ground potential and a second DC bus RL4 at a voltage HV+, for example 320V. The bridge circuit includes a first branch with a pair of (schematically illustrated) switches S1, S2 connected in series across buses RL3, RL4 and a second branch in parallel to the first branch including half-bridge supply capacitors C61, C62 also series connected across buses RL3, RL4. A resonant load branch is connected in series between the midpoints M1, M2 between the capacitors C61, C62 and the switches S1, S2, respectively. The load branch includes lamp L connected in series with inductor L10, with filament heating capacitor C63 in parallel with the lamp and in series with the filament electrodes. It should be noted that the ballast capacitors C61, C62 could be replaced by a single ballast capacitor C64 (shown in dotted lines) and having the combined value of capacitors C61 and C62.

Control circuits for driving the switches S1, S2 are well known in the art, and not being relevant to the detection circuit, will not be further discussed. In nominal operation with a 50% duty cycle on each of switches S1 and S2, the voltage at midpoint M1 is ½ HV+. A DC voltage appearing across the lamp in its rectifying state will be reflected at point M1 as an offset voltage. This can be detected and used to stop inverter oscillation and turn off the lamp.

The detection circuit employs some of the same components and logic as used in the immediately preceding embodiment. Consequently, components the same as those in FIG. 5(*b*) share the same reference numerals. A low voltage bus VDD provides power to the counter CTR at terminal VCC. The resistors R61 and R62 are connected in series between the midpoint M1 and ground, and reduce the voltage detected at point M1 sufficiently to protect the remaining components of the detection circuit. The capacitor C65 is connected in parallel with the resistor R62 and forms together with the resistor R62 a low pass filter which filters out the high frequency component of the signal at node M1 caused by the high frequency switching of half-bridge switches S1, S2. The resistors R63, R64 and R65 are connected in series between the Vdd bus and ground and form a voltage divider which provides a first voltage trip point at a node between the resistors R64 and R65 and a second voltage trip point between the resistors R63 and R64. The two trip points correspond to HV+/2 plus and minus (+/−) the desired threshold value for asymmetry detection. A comparator COMP1 has its inverting (−) input terminal connected to the node between the resistors R63 and R64 and a comparator COMP2 has its non-inverting (+) input terminal connected to the node between the resistors R64 and R65. The non-inverting (+) input terminal of the comparator COMP1 and the inverting (−) input terminal of the comparator COMP2 are connected to a node between the resistors R61 and R62. The outputs of the comparators COMP1 and COMP2 are connected to the input of a NOR gate. The NOR gate also has an input connected to the "OR"ed outputs Q11, Q12, Q13 of the counter CTR. The output of the NOR gate is coupled to the base of bipolar switch Q21. The collector of switch Q21 is connected to the CT and RT terminals and the emitter of switch Q21 is connected to ground in the same manner as in FIG. 5*b*.

The detection circuit operates as follows. When the DC voltage at node M1 is above the higher voltage trip point, the output of the comparator COMP1 will be high and if the DC voltage at node M1 is below the lower voltage trip point, the output of the comparator COMP 2 will be high. Either situation corresponds to the DC voltage across the lamp due to asymmetric operation being greater than the selected threshold. Whenever either of the outputs of COMP1 or COMP2 are high, the output of the NOR gate is low, switch Q21 is open, and the counter CTR counts up. The counter will continue to count up through the first time period, after which the "OR"ed output of the counter CTR becomes high, closing the mosfet switch Q22. The drain of mosfet Q22 is connected to ground and the source is connected to the base or control gate of one of the inverter switches S1, S2. Alternatively, the source of switch Q22 may be connected to a control or power supply input of a control circuit for the switches S1, S2. For either case, the switch Q22 when conductive prevents inverter oscillation and extinguishes the lamp. The circuit provides the same hiccup operation as in FIG. 5(*b*). It is also possible for the output of the NOR gate to be connected to a control or power supply input of a control circuit for the switches S1, S2.

While there has been shown to be what are considered to be the preferred embodiments of the invention, it will be apparent to those of ordinary skill in the art that various modifications can be made without departing from the scope of the invention as defined by the appended claims. Accordingly, the disclosure is illustrative only and not limiting.

We claim:

1. A ballast for a gas discharge lamp, comprising a current limiting AC voltage source for maintaining a column discharge in the discharge lamp alternately with one polarity and with the opposite polarity, and a detection circuit for detecting asymmetry between the column discharge of one polarity and the column discharge of the opposite polarity, characterized in that:

said detection circuit detects a DC voltage generated by the discharge lamp with asymmetry occurring between the column discharges of the one polarity and the opposite polarity; and said detection circuit measures the amount of time the DC voltage is above a threshold value and changes the output of the current limiting AC voltage source after the measured amount of time exceeds a first threshold time value.

2. A ballast according to claim 1, characterized in that said detection circuit includes (i) a device coupled to the discharge lamp during operation such that the DC voltage is reflected across said device when the lamp current is different for the column discharge of one polarity verses the other polarity, and (ii) sensing means for sensing the DC voltage across said device.

3. A ballast according to claim 2, characterized in that said device comprises a capacitive means for exhibiting capacitive characteristics.

4. A ballast according to claim 3, characterized in that:

said sensing means senses when the DC voltage across said device exceeds said threshold value; and said detection circuit is coupled to said current limiting voltage source for changing the output of said voltage source when said DC voltage exceeds said threshold value.

5. A ballast according to claim 4, characterized in that said detection circuit includes a breakdown device which conducts only when a DC voltage exceeding said threshold value occurs across said device.

6. A ballast according to claim 4, characterized in that said threshold value corresponds to a level of asymmetry during which a column discharge of each said polarity is maintained in the discharge lamp.

7. A ballast according to claim 6, characterized in that said detection circuit includes control means for controlling said current limiting voltage source to recurrently ignite and extinguish the discharge lamp.

8. A ballast according to claim 4, further comprising means for controlling said current limiting AC voltage source to control the light level emitted by the discharge lamp between a maximum light level and light levels lower than said maximum light level, said threshold value being set such that the DC voltage exceeds said threshold value for asymmetry between the column discharges of each polarity at a light level lower than said maximum light level.

9. A ballast according to claim 3, characterized in that said capacitive means is coupled in series with the discharge lamp for limiting the current through the discharge lamp.

10. A ballast according to claim 3, characterized in that said capacitive means is coupled in series with the discharge lamp for blocking DC components from the lamp.

11. A ballast according to claim 2, characterized in that said current limited AC voltage source includes a DC source, a bridge inverter including a pair of switches series connected across said DC source and a load circuit including the discharge lamp, said load circuit having one end coupled to a node between said switches, and said device being coupled in series with the load circuit.

12. A ballast according to claim 11, characterized in that:

said detection circuit senses when the DC voltage across said device exceeds said threshold value; and said detection circuit is coupled to said bridge inverter for changing the operation of said bridge inverter when said DC voltage exceeds said threshold value.

13. A ballast according to claim 12, characterized in that said threshold value corresponds to a level of asymmetry in which a column discharge of each said polarity is maintained in the discharge lamp.

14. A ballast according to claim 13, characterized in that said detection circuit controls said bridge inverter to recurrently ignite and extinguish the discharge lamp.

15. A ballast according to claim 11, wherein said AC source further includes a bridge supply capacitor coupled to a second end of said load circuit, and said device is coupled to said second end of said load circuit.

16. A ballast according to claim 1, characterized in that:

said detection circuit senses when the DC voltage across said device exceeds said threshold value; and said detection circuit is coupled to said current limiting voltage source for changing the output of said voltage source when said DC voltage exceeds said threshold value.

17. A ballast according to claim 16, characterized in that said threshold value corresponds to a level of asymmetry in the lamp current during which a column discharge of each said polarity is maintained in the discharge lamp.

18. A ballast according to claim 17, characterized in that said detection circuit includes control means for controlling said current limiting AC voltage source to recurrently ignite and extinguish the discharge lamp.

19. A method of operating a gas discharge lamp, said method comprising the steps of:

a) providing an AC voltage across said discharge lamp for maintaining a column discharge in the discharge lamp alternately with one polarity and with the opposite polarity;

b) detecting a DC voltage generated by an asymmetric operating state of the lamp in which the lamp current for the column discharge of one polarity is different from the lamp current for the column discharge of the other polarity; and c) measuring the amount of time that the DC voltage exceeds a threshold value, and changing the operation of the discharge lamp when said measured amount of time exceeds a first threshold time value.

20. A method according to claim 19, further comprising:

changing the operation of said discharge lamp when said DC voltage exceeds a predetermined threshold value.

21. A method according to claim 19, wherein said step of changing the operation includes extinguishing the discharge lamp.

22. A method according to claim 19, wherein said step of changing the operation of the discharge lamp includes recurrently extinguishing and igniting the discharge lamp.

23. A method according to claim 19, wherein said step of measuring the time that the DC voltage exceeds the threshold voltage includes storing a time value when the DC voltage falls below the threshold voltage and incrementing the time value when the DC voltage subsequently exceeds the threshold value.

24. A ballast for a gas discharge lamp, said ballast comprising:

a) input terminals for connection to an AC mains supply having a mains supply frequency, b) output terminals for connection to a gas discharge lamp having a pair of discharge electrodes between which a column discharge is maintainable during lamp operation, c) ballasting means connected between said input terminals and said output terminals, said ballasting means providing an AC voltage at said output terminals to maintain a column discharge between the discharge electrodes of the discharge lamp alternately with one polarity and with the opposite polarity at a frequency substantially higher than the mains supply frequency, and d) detecting means for detecting a DC voltage generated by an asymmetric operating state of the lamp in which the lamp current for the column discharge of one polarity is different from the lamp current for the column discharge of the other polarity, said detecting means including means for measuring the amount of time that the DC voltage exceeds a threshold value and for changing the operation of the discharge lamp when said measured amount of time exceeds a first threshold time value.

25. A ballast according to claim 24, wherein said ballasting means includes a DC blocking capacitor electrically in series with one of said output terminals for blocking DC components generated by the discharge lamp, and said detecting means detects a DC voltage reflected across said DC blocking capacitor by the discharge lamp operating in said asymmetric operating state.

26. A ballast according to claim 24, wherein said ballasting means includes a ballasting capacitor coupled electrically in series with one of said output terminals for limiting the current in the discharge lamp, and said detection circuit detects a DC voltage reflected across said ballasting capacitor by the discharge lamp operating in said asymmetric operating state.

27. A ballast according to claim 24, wherein said ballasting means includes a DC source having a DC potential, a bridge inverter including a pair of switches series connected across said DC source, a load circuit including the discharge lamp, said load circuit having a first end coupled to a node between said switches and a second end, a half bridge supply capacitor coupled to the DC source and said second end of said load circuit, and means for switching said switches to generate an AC signal across the discharge lamp, said switches being switched such that said second end of said load circuit has a nominal voltage in a non-asymmetric operating condition of the lamp equal to one-half said DC potential, said detection circuit detecting the DC voltage generated by said asymmetric operating state of the lamp by sensing a variation of the DC voltage from said nominal voltage at said second end of said load circuit.

28. A ballast according to claim 27, wherein said detection circuit includes means for setting a high trip voltage equal to said nominal voltage plus a DC threshold value and a low trip voltage equal to said nominal voltage minus said DC threshold value, means for comparing the DC voltage at second end of said load circuit with said high and low trip voltages, and means for outputting a control signal when the DC voltage at said second end of said load circuit is higher than said high trip voltage and lower than said lower trip voltage.

29. A ballast according to claim 28, wherein said means for measuring measures the amount of time that said DC voltage is higher than said high trip voltage and lower than said low trip voltage and for outputting a first control signal when said measured amount of time exceeds a first time threshold value.

30. A ballast according to claim 29, wherein said detection circuit includes means for extinguishing said lamp when said measured time value exceeds the first time threshold value.

31. A ballast according to claim 29, wherein said detection circuit includes means for generating a second control signal within a predetermined time after said first control signal, and said ballast includes means for igniting the discharge lamp upon the generation of said second control signal.

32. A ballast according to claim 24, wherein:

said detection circuit further includes means for generating a first control signal when said measured time exceeds said first time value, and means for generating a second control signal within a predetermined time after the occurrence of said first control signal; and said ballasting means is responsive to said first control signal to stop providing said AC signal at said output terminals, thereby extinguishing the discharge lamp, and is responsive to said second control signal to provide an AC voltage at said output terminals to ignite and maintain a column discharge in said discharge lamp.

33. A ballast according to claim 32, wherein said means for measuring the time that the DC voltage exceeds the first threshold value includes means for storing a time value when the DC voltage falls below the threshold voltage and for incrementing the time value when the DC voltage subsequently exceeds the threshold value.

34. A ballast according to claim 32, wherein:

said ballasting means includes a control input for receiving a dimming signal indicative of a light level of the discharge lamp, said ballasting means being responsive to said dimming signal to adjust said AC voltage at said output signal for controlling the light level emitted by the discharge lamp between a maximum light level and light levels lower than said maximum light level and corresponding to said dimming signal, said first threshold value being set such that the DC voltage exceeds said first threshold value for asymmetry between the column discharges of each polarity at a light level lower than said maximum light level.

35. A dimming ballast for a gas discharge lamp, said ballast comprising:

mains input terminals for receiving an AC mains voltage;

a full bridge rectifier connected to said input terminals for providing a full wave rectified DC output voltage;

a pre-conditioner circuit connected to the full-bridge rectifier, said pre-conditioner circuit including an up converter for providing a DC supply voltage at a level higher than the peak voltage of the rectified DC output voltage from said full-bridge rectifier;

an inverter circuit receptive of the DC supply voltage from said pre-conditioner circuit, said inverter converting the DC supply voltage from said preconditioner to a high frequency AC voltage having a frequency substantially greater than the frequency of the AC mains supply;

a resonant tank output circuit receptive of the high frequency AC inverter output voltage, said output circuit having lamp connection terminals for connection to a gas discharge lamp, said output circuit providing a substantially sinusoidal lamp current to a gas discharge lamp connected at said lamp terminals for maintaining a column discharge between the discharge electrodes of the discharge lamp alternately with one polarity and with the opposite polarity;

a control circuit connected to said inverter for controlling the AC inverter output voltage, said control circuit: having (i) means for receiving a dimming signal (ii) means for sensing the power supplied to the gas discharge lamp, and (iii) means for adjusting the AC inverter output frequency fed to said resonant tank output circuit to thereby control the electrical power supplied to the gas discharge lamp at a level corresponding to the dimming signal; and detecting means for detecting a DC voltage generated by an asymmetric operating state of the lamp in which the lamp current for the column discharge of one polarity is different from the lamp current for the column discharge of the other polarity, and means for measuring the amount of time that the DC voltage exceeds a threshold value to change the output of the inverter circuit when the amount of time exceeds a time threshold value.

36. A dimming ballast according to claim 35, wherein:

said detecting means is coupled to one of (i) said inverter circuit and (ii) said control means for changing the output of said inverter circuit when said DC voltage exceeds said threshold value; and said threshold value being set such that the DC voltage exceeds said threshold value for asymmetry between the column discharges of each polarity at levels of electrical power supplied to the gas discharge lower than a minium power corresponding to a maximum light output of the lamp.

37. A ballast for a gas discharge lamp, comprising a current limiting AC voltage source for maintaining a column discharge in the discharge lamp alternately with one polarity and with the opposite polarity, and a detection circuit for detecting asymmetry between the column discharge of one polarity and the column discharge of the opposite polarity, characterized in that:

said detection circuit detects a DC voltage generated by the discharge lamp with asymmetry occurring between the column discharges of the one polarity and the opposite polarity; and means, responsive to said detection circuit detecting a DC voltage exceeding a threshold value, for recurrently extinguishing and igniting the gas discharge lamp to cause said lamp to blink.

38. A ballast for a gas discharge lamp, comprising a current limiting AC voltage source for maintaining a column discharge in the discharge lamp alternately with one polarity and with the opposite polarity, and a detection circuit for detecting asymmetry between the column discharge of one polarity and the column discharge of the opposite polarity, characterized in that:

said detection circuit detects a DC voltage generated by the discharge lamp with asymmetry occurring between the column discharges of the one polarity and the opposite polarity;

said detection circuit being coupled to said current limiting voltage source for changing the output of said voltage source when said DC voltage exceeds a threshold value;

said current limiting AC voltage source controlling the light level emitted by the discharge lamp between a maximum light level and light levels lower than said maximum light level; and said threshold value being set such that the DC voltage exceeds said threshold value for asymmetry between the column discharges of each polarity at a light level lower than said maximum light level.

* * * * *